United States Patent [19]

Flaschar et al.

[11] 4,080,994

[45] Mar. 28, 1978

[54] CONTROL ARRANGEMENT FOR SUPPLYING PRESSURE FLUID TO AT LEAST TWO HYDRAULICALLY OPERATED CONSUMER DEVICES

[75] Inventors: Heinz Flaschar, Asperg; Peter Kroll, Gemmrigheim; Petrus Thomassen; Heinz Kleinschmidt, both of Ditzingen; Hugo Preün, Asperg, all of Germany

[73] Assignee: Robert Bosch GmbH, Stuttgart, Germany

[21] Appl. No.: 746,323

[22] Filed: Dec. 1, 1976

[30] Foreign Application Priority Data

Jan. 16, 1976 Germany ..... 2601484

[51] Int. Cl.[2] ..... F15B 13/08

[52] U.S. Cl. ..... 137/596.13; 91/414

[58] Field of Search ..... 137/596.12, 596.13; 91/414, 411 R, 451, 468

[56] References Cited

U.S. PATENT DOCUMENTS

| | | | |
|---|---|---|---|
| 3,744,518 | 7/1973 | Stacey | 137/596.12 |
| 3,854,289 | 12/1974 | Hermann et al. | 60/484 |
| 3,864,913 | 2/1975 | Hermann | 91/411 R |
| 3,910,045 | 10/1975 | Hermann | 91/414 |
| 4,030,522 | 6/1977 | Heiser | 137/596.13 |

FOREIGN PATENT DOCUMENTS

| | | | |
|---|---|---|---|
| 2,420,565 | 11/1974 | Germany | 91/411 R |

*Primary Examiner*—Martin P. Schwadron
*Assistant Examiner*—A. M. Chambers
*Attorney, Agent, or Firm*—Michael J. Striker

[57] ABSTRACT

A control arrangement for supplying pressure fluid through a supply conduit from a source of pressure fluid to at least two hydraulically operated consumer devices includes, for each of the consumer devices, a valve having a valve member movable axially between a neutral position preventing flow of pressure fluid to the respective consumer device and two working positions respectively connecting the consumer device to the source of pressure fluid or a return conduit. A throttle is located in the supply conduit between a first point of the latter from which a first branch conduit branches off to a first of the valves and a second point from which a second branch conduit branches off to the second of the valves. The arrangement includes further a control valve and a control circuit therefor, controllable at least by the valve member of one of the valves. In the neutral position of all valve members the supply conduit is connected with the return conduit to form therewith a neutral fluid circulation passage.

19 Claims, 7 Drawing Figures

CONTROL ARRANGEMENT FOR SUPPLYING PRESSURE FLUID TO AT LEAST TWO HYDRAULICALLY OPERATED CONSUMER DEVICES

BACKGROUND OF THE INVENTION

The present invention relates to a control arrangement for at least two hydraulically operated consumer devices to be supplied with pressure fluid from a source of such pressure fluid. The control arrangement includes, for each of the consumer devices, a valve with an axially movable valve member movable between a neutral position preventing flow of pressure fluid to the respective consumer device and two working positions respectively connecting the consumer device to a source of pressure fluid or a return conduit. The arrangement includes further a control valve and a control circuit therefor, controllable at least by the valve member of one of the valves, and in the neutral position of all valve members, the supply circuit is connected with the return circuit to form therewith a neutral fluid circulation passage.

A control arrangement of this kind is known in the art in which the neutral circulation passage and the control circuit passes through the housings of all valves and in which a control valve is provided which functions to limit the pressure of the pressure fluid and to control the neutral circulation passage. In this known control arrangement a first valve may be supplied with a constant fluid stream and a second valve with a partial, respectively, a full fluid stream, for which purpose, however, an additional flow regulating valve is necessary. This known control arrangement has the disadvantage that it is complicated in its construction, requires a relatively large space and is unsuitable for special applications.

SUMMARY OF THE INVENTION

It is an object of the present invention to provide a control arrangement of the aforementioned kind which avoids the disadvantages of such arrangements known in the art.

It is a further object of the present invention to provide a control arrangement of the aforementioned kind which is simpler and compacter than such arrangements known in the art and which is especially adapted for special applications.

With these and other objects in view, which will become apparent as the description proceeds, the control arrangement according to the present invention for supplying pressure fluid to at least two hydraulically operated consumer devices, mainly comprises a source of pressure fluid, a supply conduit connected at one end to the source of pressure fluid, and return conduit connectable to the other end of the supply conduit, a valve means for each of the consumer devices and each having a valve member movable between a neutral position preventing flow of fluid from the supply conduit to the consumer conduit connected to each of the valve means and a pair of working positions respectively connecting the consumer conduit with the supply conduit or the return conduit, while in the neutral position of all valve means the supply conduit is connected to the return conduit to form therewith a neutral circulation passage. A first branch conduit connects a first point of the neutral circulation passage with an inlet chamber of one of the valve means and a second branch conduit connects a second point of the neutral circulation passage, downstream of the first point, with the inlet chamber of the other valve means, while a throttle is arranged in the passage between the first and the second point. The arrangement includes further a control valve formed with a throttle passage therethrough and being movable between a closed position and an open position in which it connects the neutral circulation passage upstream of the aforementioned throttle with the return conduit. A control circuit passing through the one valve means, and being controlled by the latter, connects the control valve to a point of the passage downstream of the aforementioned throttle and upstream of the other valve means.

The one valve means of the arrangement can in this way control an amount of pressure fluid to one of the consumers, which is about twice as large as the amount of pressure fluid controlled by the other valve means, whereby the pressure losses during circulation of the fluid through the neutral circulation passage will remain within accessible limits. The control valve will perform in addition to the two functions of pressure regulating and controlling the neutral circulation passage, the function of a pressure balancer for regulating a constant fluid stream. The arrangement according to the present invention omits therefore an additional fluid stream regulating valve as well as a control circuit passing through all of the valves of the control arrangement.

An especially advantageous arrangement is derived according to the present invention, when the first valve means has a third control chamber controllable by the valve member thereof, which is connected by means of a second control circuit with the inlet chamber of the second valve means. In this way it is possible to obtain a favored supply of pressure fluid to the consumer which is controlled by the second valve means. This consumer is also supplied with a smaller amount of pressure fluid and may be actuated independent from the position of the first valve means and the pressure and fluid conditions prevailing at the latter.

It is also advantageous, in accordance with the present invention, to connect the first control circuit downstream of the first valve means by means of a third control circuit with a secondary overpressure valve, the discharge end of which may be hydraulically blocked by the valve member of the second valve means or connected with the return conduit. In this way it is possible to provide a second pressure protection of the consumer which is connected with the second valve means. This construction is simple in that the additional pressure limiting valve serves only as an anticipatory control, while the main control of the pressure fluid is carried out by the first mentioned control valve.

A load independent control can in an advantageous manner be obtained with the first valve means, when the latter is provided with a third control chamber controllable by the valve member of the first valve means and in which this third control chamber is connected by a fourth control circuit with the consumer chamber of the first valve means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
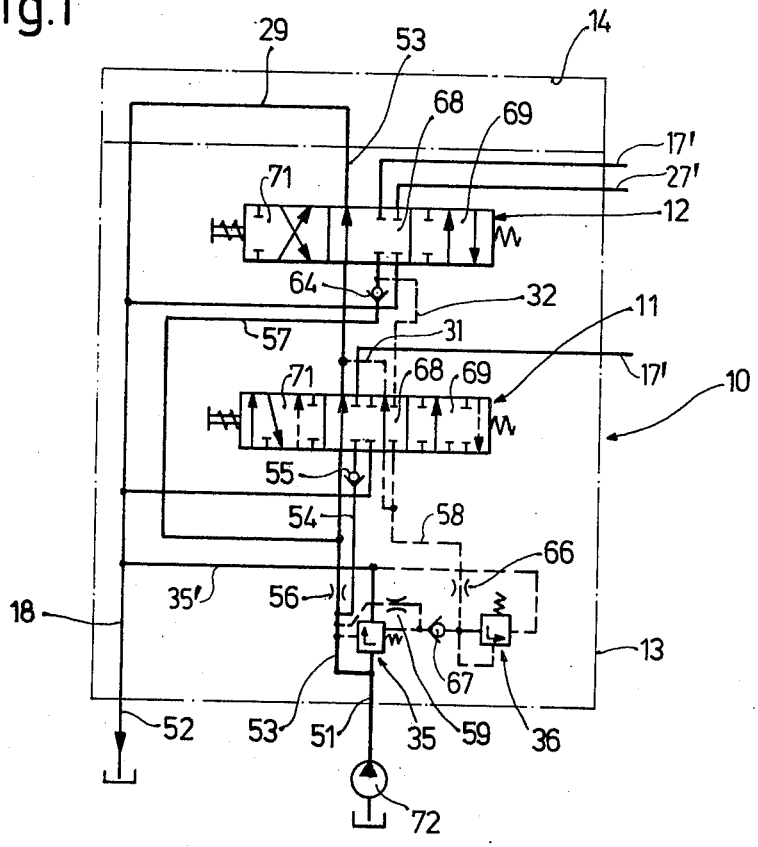
FIG. 1 is a circuit diagram of a first embodiment of the control arrangement according to the present invention.
Figure 2:
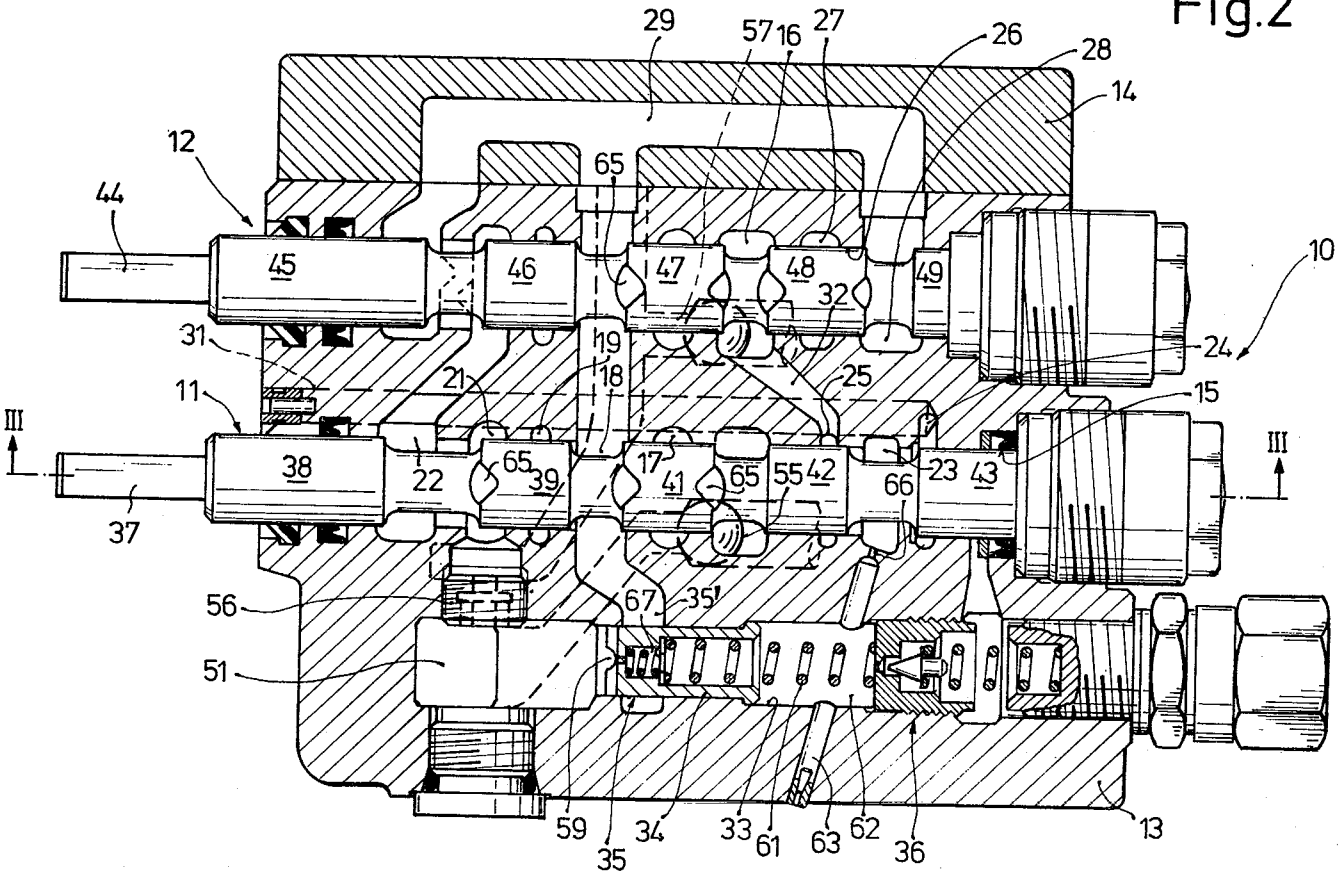
FIG. 2 is a longitudinal section through the control arrangement according to the diagram of FIG. 1.
Figure 3:
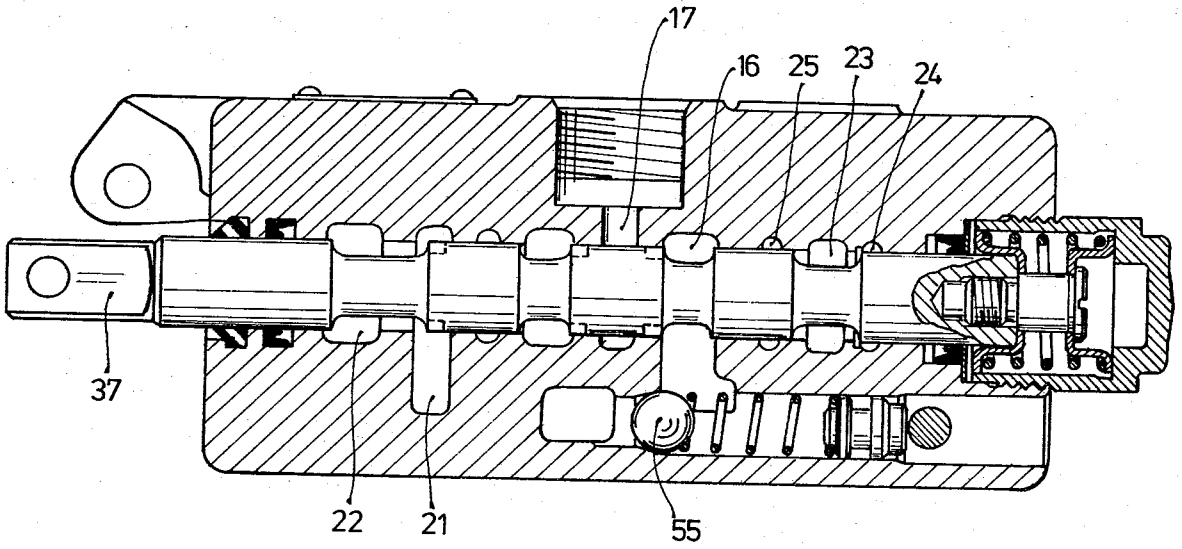
FIG. 3 is a cross-section taken along the line III—III in FIG. 2.

Referring now to the drawing, and more specifically to FIGS. 1–3 of the same, it will be seen that the first embodiment of a control arrangement 10 illustrated therein comprises a first valve means 11 and a second valve means 12, arranged in a common housing 13, to which an end plate 14 is flanged.

As best seen in FIGS. 2 and 3, the housing 13 is provided with a longitudinal bore 15 therethrough in which a first valve spool or valve member 37 is slidably guided. An inlet chamber 16 about the valve member 37 is provided in the bore 15 and adjacent to this inlet chamber 16 is, to one side thereof, a consumer chamber 17 connected by a conduit 17' to a consumer device, not shown, a return chamber 18, an operating chamber 19, as well as two circulating chambers 21 and 22. On the other side of the inlet chamber 16 are arranged an intermediate first control chamber 23, as well as a second control chamber 24 and a third control chamber 25, whereby the last one is arranged between the inlet chamber 16 and the control chamber 23. The second valve means 12 has a longitudinal bore 26 for a second valve member 44 and the bore 26 is provided with the same chambers 16, 17, 18, 19, 21 and 22 as the first bore 15; however, instead of the three control chambers 23-25, the second bore 26 is provided with a second consumer chamber 27 and a second return chamber 28 which is connected through a channel 29 in the end plate 14 with the first return chamber 18 and the circulation chamber 22 of the valve means 12. The first and the second consumer chambers of the second valve means 12 are also connected by conduits 17' and 27' to additional consumer devices, not shown in the drawing. A bore 31 in the housing 13 connects the second control chamber 24 with the circulating chamber 22 of the first valve means 11, and a channel 32 connects the third control chamber 25 of the first valve means 11 with the inlet chamber 16 of the second valve means 12. The housing 13 is further provided with a blind bore 33, having a plurality of sections of different diameters, in which the valve body 34 of a control valve 35 is arranged, which is precontrolled by a pressure limiting valve 36, likewise arranged in the blind bore 33. The valve member 37, slidably guided in the first bore 15, has five sections or lands 38, 39, 41, 42 and 43 separated from each other by annular grooves, whereas the second valve member 44, which is slidably guided in the bore 26, is likewise provided with five sections or lands 45, 46, 47, 48 and 49 separated from each other likewise by annular grooves.

The supply conduit or passage 51 of the control arrangement 10 forms over the circulation chambers 21, 22 of both valve means 11 and 12, the channel 29 in the end plate 14 and the return chambers 18 of both valve means 11 and 12 a neutral circulation passage 53 which leads to the return conduit or passage 52. A first branch circuit 54 branches off from a point of the passage 53 and leads over a one-way or check valve 55 to the inlet chamber 16 of the first valve means 11. A second branch circuit 57 branches off from the passage 53 at a second point downstream of the first point and leads over a one-way or check valve 64 to the inlet chamber 16 of the second valve means 12 to thereby connect the second valve means 12 in parallel with the first valve means 11. A throttle 56 is arranged in the passage 53 between the above-mentioned first and second points from which the first and the second branch circuit branches off. A first control circuit 58 leads further from the supply conduit 51 over a throttle passage 59 in the valve member 34 of the control valve 35 to a control space 62, housing a spring 61 which biases the valve member 34 of the control valve 35 to the closed position, as shown in FIG. 2. The first control circuit 58 leads further over a cross bore 63, the first and second control chambers 23 and 24, the bore 31 to the neutral circulation passage 53 downstream of the throttle 56. A channel 32 which starts at the second control chamber 25, forms a second control circuit, which leads, downstream of the check valve 64, into the branch circuit 57 of the second valve means 12. Some of the sections of the valve members 37 and 34 are also provided with chamfers 65 for precision control of the fluid.

An additional throttle 66 and a check valve 67 are provided in the first control circuit 58. The throttle 66 is provided in the cross bore 63 and the check valve 67 is preferably directly arranged in the valve member 34.

Each of the valve members 37 and 44 is movable from a middle or neutral position 68, shown in FIGS. 1 and 2, to a first working position 69 and a second working position 71 in which they establish the connections as can be visualized from FIG. 1.

Figure 4:
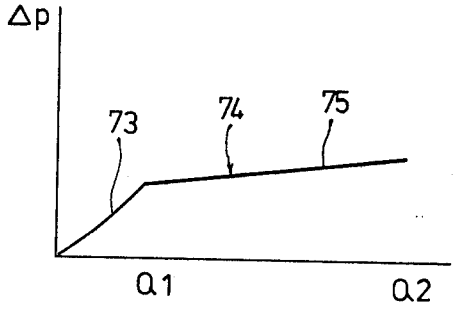
FIGS. 4 and 5 illustrate characteristic curves for the control arrangement according to FIG. 1.

The above-described control arrangement 10 will operate as follows:

If the two valve members 37 and 44 are in the shown middle or neutral position 68, all of the consumer chambers 17 and 27 of the first, single acting valve means 11 as well as of the second, double-acting valve means 12 are hydraulically blocked. The neutral circulation passage 53 is open and pressure fluid pumped by the pump 72 will flow from the supply conduit 51 to the return conduit 52. At the same time a very small partial stream, determined by the relationship of the cross-sections of the throttles 56 and 59 relative to each other, will flow from the inlet conduit 51 over the throttle passage 59, the control space 62, the cross bore 63, the first and second control chamber 23, 24 and the bore 31 into the neutral circulation passage 53 between the first valve means 11 and the second valve means 12. At the same time the throttle 56 will form a pressure difference, which will act on the valve body 34 of the control valve 35. As long as the amount of pressure fluid flowing through the neutral circulation passage 53 is smaller than a predetermined amount Q1, the pressure difference formed by the throttle 56 will be too small in order to move the valve member 34 against the forces holding the same in the closed position shown in FIG. 2. The control valve 34 will remain closed and with the exception of the very small partial stream passing through the throttle passage 59 of the control valve, the pressure fluid pumped by the pump will flow from the supply conduit 51 over the neutral circulation passage 53 to the return conduit 52. The diagram of FIG. 4 illustrates this condition at the section 73 of the characteristic curve 74, in which diagram the pressure drop $\Delta p$ is shown on the ordinate and the amount of pressure fluid Q is shown on the abscissa of the diagram.

If now the amount of pressure fluid pumped by the pump 72 surpasses the amount Q1, the pressure difference produced by the throttle 56 will likewise increase, to finally open the valve member 34 against the force of the spring 61 acting thereon. Additional pressure fluid will now flow directly from the supply conduit 51 over the control valve 34 to the return conduit 52. In this way the amount of pressure fluid Q2 can, while the pressure drop will remain within acceptable limits, be a multiple of the amount of fluid Q1 which flows through the neutral circulation passage 53. This relationship between Q1 and Q2 is shown in the section 75 of the characteristic curve 74, which shows that, with increasing amounts of pressure fluid above the amount Q1, the resulting pressure drop will increase considerably slower. In this way the control arrangement 10 can provide the first valve means 11 with a large, and the second valve means 12 with a small amount of pressure fluid, while maintaining a relatively small pressure drop.

Figure 5:
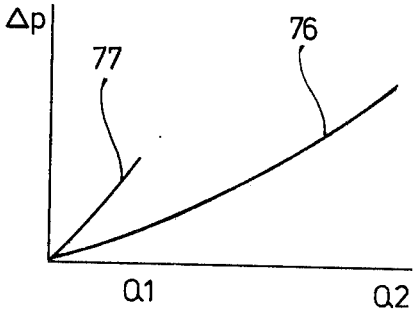

If the valve member 37 is moved toward the left, as viewed in FIG. 2, and is therefore brought to its first working position 69, the section 39 thereof closes the neutral circulation passage 53 whereas the section 41 opens the connection between the inlet chamber 16 and the consumer chamber 17. At the same time the section 43 of the valve member 37 interrupts the first control circuit 58. The fluid pressure acting on opposite sides of the valve member 34 will be equalized by means of the throttle passage 59 and the check valve 67, and the spring 61 moves the valve member 34 to its closed position, preventing thereby flow of fluid through the passage 35' to the return conduit 52. The fluid medium pumped by the pump will flow from the inlet conduit 51 over the first branch circuit 54, the check valve 55, and the inlet chamber 16 direct into the consumer chamber 17 and from there through the conduit 17' to the consumer device, not shown. The neutral circulation passage 53 is thereby closed and the throttle 56 will not become active. FIG. 5 illustrates in a first characteristic line 76 the pressure drop $\Delta p$ for an amount of pressure fluid Q, when the pressure fluid flows from the inlet conduit 51 over the first valve means 11 directly to the consumer. In the first working position 69, the first control chamber 23 is connected with the third control chamber 25 and the channel or second control circuit 32. Since the latter is closed at its downstream end by the valve member 44, maintained in its neutral position 68, and the check valve 64, the pressure in the control space 62 cannot be exhausted over the second control circuit 32.

In order to discharge pressure fluid from the consumer connected to the consumer chamber 17, the valve member 37 of the first valve means 11 is moved towards the right, as viewed in FIG. 2, to its second working position 71. Thereby the section 41 of the valve member 37 will release pressure fluid from the consumer chamber 17 to the return chamber 18; the neutral circulation passage 53 remains thereby open, as well as the first control circuit 58.

If the first valve member 37 is maintained in the neutral position 68 shown, and if now the second valve member 44 is moved to its first working position 69, pressure fluid is supplied to the first consumer chamber 17 of the valve means 12 and the amount of such pressure fluid will be limited to a maximum amount Q1 by means of the throttle 56 in connection with the control valve 35. At the same time fluid will flow from the second consumer chamber 27 to the return chamber 28. The amount of pressure fluid Q2 – Q1, pumped by the pump 72, flows thereby over the valve member 34, which acts as pressure equalizer, directly to the return conduit 52. The per se detrimental influence of the throttle passage 59 is thereby negligibly small, because its free cross-section is relatively small so that only a very small fluid stream will pass through the first control circuit 58. The neutral circulation passage is in the working positions 69 and 71 closed. The second characteristic line 77 in FIG. 5 shows the pressure drop $\Delta p$ in dependence upon the amount of pressure fluid Q flowing from the inlet conduit 51 to the consumer chamber 17, respectively 27, of the second valve means 12. This characteristic line 77 is considerably steeper than the first characteristic line 76 since the throttle 56 will determine the flow resistance.

The second valve means 12 can, in correspondence with its double acting function, supply also pressure fluid to the second consumer chamber 27 of the second valve means, while discharging pressure fluid from the first consumer chamber 17 thereof.

If the first valve member 37 is in its first working position 69 and if the second valve member 44 is simultaneously moved also to its first working position 69, then the consumer controlled by the second valve member 44 will be favored. The consumer pressure in the second valve means 12 will be built up over the second control circuit 32 in the control space 62. The check valve 67 prevents a connection with the inlet conduit 51 if a lower pressure should prevail in the latter. If the consumer pressure at the second valve means 12 is lower than that at the first valve means 11, then the check valve 55 in the first valve means 11 will prevent lowering of the load connected thereto. The pressure in the inlet conduit 51 will be adjusted to a pressure which is only slightly higher than the pressure of the load connected to the second valve means 12. The volume of the pressure medium stream will be regulated by the throttle 56 and the valve member 34 acting as pressure equalizer to the volume Q1, whereby a surplus of the pressure medium will flow to the return conduit 52. At such a function a very small control fluid stream will flow over the throttle passage 59 and the second control circuit 32 to the second valve means 12. Since the cross-section of the throttle passage 59 is very small, preferably about one-tenth of that of the throttle 56, the disturbing influence on the pressure equalization function will be negligibly small.

Assuming the hydraulically operated consumers connected to the arrangement are in the form of cylinder and piston means, and assuming the pressure load acting on the cylinder and piston means connected to the second valve means 12 is greater than the load acting on the cylinder and piston means connected to the first valve means 11, then the cylinder and piston means on which the lower load acts, and which is connected to the first valve means 11 will be fully extended during the above-described operation, whereby the maximum amount Q2 will be available, and subsequently thereto ergy pipe 52 and further aids in restraining its lateral movement.

Referring to FIG. 5 another form of omni-directional pipe restraint is illustrated. A single pipe restraint 10C having a laminated strap 17C for restraining upward movement is shown in use with a pair of restraining pipes 50A and B which have their ends 62A and 62B cut normal to their axes. The right angle restraining pipes 50A and 50B are positioned below the high energy pipe 52 in line with the transverse axis thereof to in effect form a V for restraining lateral and downward movement of the ruptured high energy pipe 52.

Figure 6:
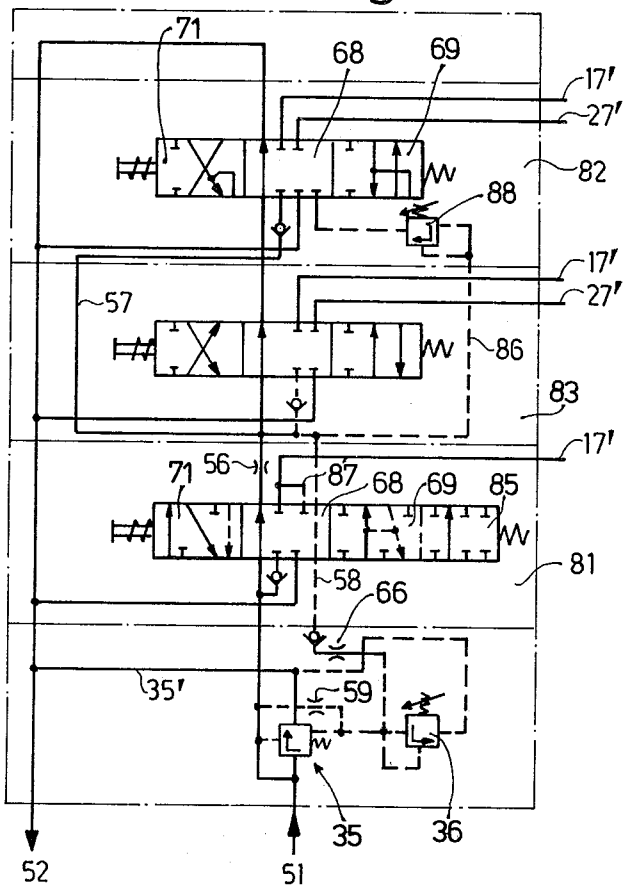
FIG. 6 is a circuit diagram of a second control arrangement according to the present invention.
Figure 7:
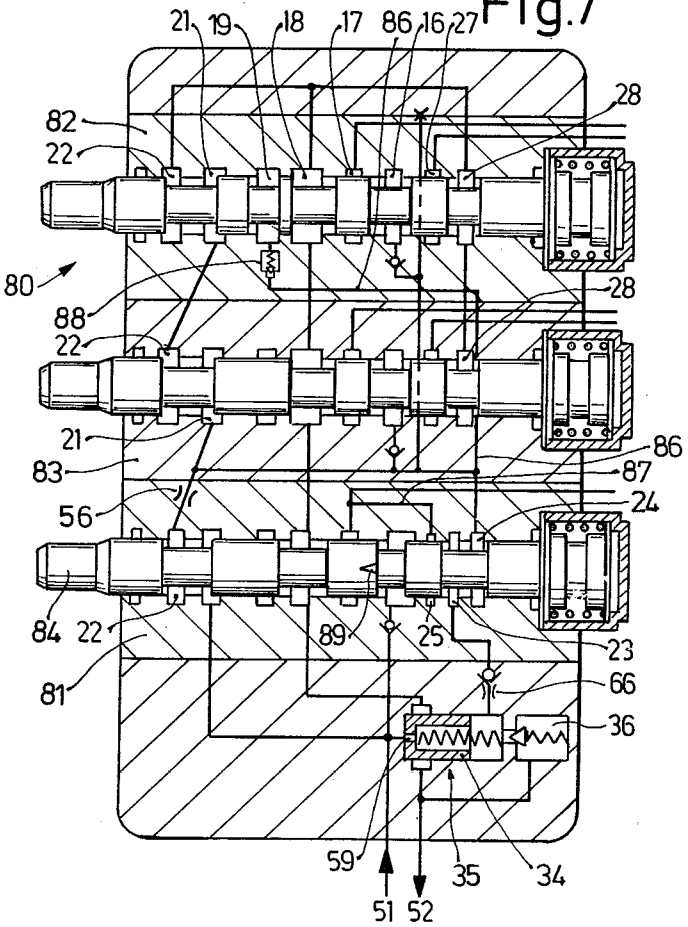
FIG. 7 is a simplified longitudinal cross-section through the second control arrangement.

The laminated strap is operably connected to clevi 32C and 34C as previously described with respect to FIG. 1. The clevi 32C and 34C are integrally formed with a pedestal support plate 55A. The pipes 50A and 50B are coupled to pedestal supports 74 and 76, see also FIG. 6, with U-bolts 68A and 70A and 68B and 70B or other means of attachment as heretofore described. The pedestal support plate 55A is bolted to an embedment plate 56A which is embedded in the concrete floor or welded to a steel structure, as desired. Advantageously, shims 58A may be positioned below the pedestal for adjusting the position of the laminated strap 17C and restraining pipes 50A and 50B relative to the high energy pipe 52.

In operation, the pipe restraint 10 shown in FIGS. 1 and 2 absorbs the impact energy of the high energy pipe 12 when it moves upwardly and impacts the arcuate portion 49 of the laminated strap 17. The strap 17 deforms plastically while undergoing substantial elongation and utilizes its laminated construction to maximize tension on the ruptured pipe 12. Thus, the ruptured pipe 12 is prevented from moving upward and damaging equipment in that area.

This same objective of restraining movement of a ruptured pipe is accomplished with the omni-directional pipe restraints of FIGS. 3 and 4, and 5 and 6, respectively. In FIGS. 3 and 4, lateral or upward movement of the ruptured high energy pipe 52 is restrained by the laminated straps 17A and 17B and downward movement of the ruptured pipe 52 is restrained by the transversely arranged restraining pipe 50 which absorbs the impact energy of the ruptured high energy pipe 52 through crushing and advantageously forms a well 72 which aids in restraining the lateral movement of the ruptured high energy pipe 52. However, in FIGS. 5 and 6 the lateral and downward movement of the ruptured high energy pipe 52 is restrained by the restraining pipes 50A and 50B which are arranged at right angles to each other, and the upward movement of the high energy pipe 52 is restrained by the laminated strap 17C.

It should be understood by those skilled in the art that various modifications may be made in the present invention without departing from the spirit and scope thereof, as described in the specification and defined in the appended claims.

What is claimed is:

1. A pipe restraint for absorbing the impact energy of a ruptured high energy pipe and restraining movement thereof in at least one direction, comprising:

a laminated strap formed of a plurality of laminae of a material having the property of substantial elongation in the plastic state for absorbing the impact energy of a ruptured high energy pipe in at least one direction, said laminated strap being shaped to extend circumferentially around at least a portion of the high energy pipe with an arcuate portion formed therein positioned adjacent the high energy pipe and spaced therefrom to restrain movement of the ruptured high energy pipe in the direction of said arcuate portion;

anchoring means coupled to the ends of said laminated strap for anchoring said laminated strap to supporting structure; and a restraining pipe positioned adjacent the high energy pipe and spaced therefrom, said restraining pipe being arranged substantially transversely to the longitudinal axis of the high energy pipe for restraining the movement of the ruptured high energy pipe in a direction different from that of said laminated strap.

2. The pipe restraint recited in claim 1, including:

support means for supporting said restraining pipe;

coupling means for coupling said restraining pipe to said support means intermediate its ends; and the ends of said restraining pipe being free to move slightly upwardly as said restraining pipe is being crushed under the impact energy of the ruptured high energy pipe to form a well which aids in preventing lateral movement of the high energy pipe relative to said restraining pipe.

3. The pipe restraint recited in claim 1 wherein said laminated strap has a U-shaped configuration.

4. The pipe restraint of claim 3 wherein said high energy pipe has an insulating covering.

5. The pipe restraint of claim 4 wherein the shortest distance between each leg of said U-shaped strap and said insulating covering is in the range of from about 1/16 to about ½ inch.

6. A pipe restraint for absorbing the impact energy of a ruptured high energy pipe and restraining movement thereof in at least one direction, comprising:

a restraining pipe positioned adjacent the high energy pipe and arranged transversely to the longitudinal axis of the high energy pipe to absorb the impact energy of the ruptured high energy pipe and restrain its movement upon encountering and crushing said restraining pipe;

support means for supporting said restraining pipe adjacent the high energy pipe;

coupling means for coupling said restraining pipe to said support means;

a pair of laminated straps each formed of a plurality of laminae of a material having the property of substantial elongation in the plastic state for absorbing the impact energy of a ruptured high energy pipe, said laminated straps being generally U-shaped and extending circumferentially around approximately 180° of the high energy pipe while being spaced therefrom, each of said laminated straps being arranged at approximately a 45° angle and on opposite sides of the transverse axis of the high energy pipe to restrain movement of the ruptured high energy pipe in the upward and lateral directions;

anchoring means coupled to the ends of said laminated straps for anchoring said laminated straps about the high energy pipe; and said restraining pipe being positioned below said high energy pipe to restrain the downward movement thereof during rupture to provide an omni-directional restraint for the high energy pipe.

7. A pipe restraint for absorbing the impact energy of a ruptured high energy pipe and restraining movement thereof in at least one direction, comprising:

1. Control arrangement for supplying pressure fluid to at least two hydraulically operated consumer devices, comprising a source of pressure fluid; a supply conduit connected at one end to said source of pressure fluid; a return conduit connectable to the other end of said supply conduit to form therewith a neutral fluid circulating passage; a valve means for each of said consumer devices; at least one consumer conduit connected to each of said valve means, each of said valve means comprising an inlet chamber connectable to said consumer conduit thereof, a valve member movable between a neutral position preventing flow of fluid from said source of pressure fluid over said inlet chamber to said consumer conduit and a pair of working positions respectively connecting said consumer conduit with said source of pressure fluid or said return conduit while in said neutral position of all valve means said supply conduit is connected to said return conduit; a first branch conduit connecting a first point of said neutral circulating passage with the inlet chamber of one of said valve means; a second branch conduit connecting a second point of said neutral circulating passage downstream of said first point with the inlet chamber of the other valve means; a throttle in said neutral circulating passage between said first and said second point; a control valve provided with an associated throttle passage and being movable between a closed position and an open position in which it connects that neutral circulating passage upstream of said throttle with said return conduit; spring means biasing the control valve to said closed position; and a first control circuit communicating at one end with said control valve and at the other end with said neutral circulating passage downstream of said throttle and upstream of said other valve means, said control circuit passing through said one valve means to be controlled by the latter.

2. A control arrangement as defined in claim 1, wherein said one and said other valve means are connected in parallel to each other.

3. A control valve arrangement as defined in claim 1, wherein said one valve means comprises a housing in which said valve member thereof is movable between said positions, said housing forming about said valve member said inlet chamber and to one side of said inlet chamber a consumer chamber connected to one of said consumer circuits, a return chamber connected to said return conduit, at least two circulating chambers following each other in the direction of the axis of the valve member, and on the other side of said inlet chamber, a third, first and second control chamber following each other in the enumerated sequence in the direction of said axis.

4. A control arrangement as defined in claim 3, and including a control space at the downstream side of said control valve and an overpressure valve communicating with said control space.

5. A control arrangement as defined in claim 4 and including a second control circuit connecting said third control chamber of said one valve means with said inlet chamber of said other valve means.

6. A control arrangement as defined in claim 4 and including a second overpressure valve and a third control circuit connecting said second overpressure valve to said first-mentioned control circuit downstream of the valve member of said one valve means, and the valve member of said other valve means being constructed and arranged to block in said neutral position thereof passage of fluid through said first control circuit and said second overpressure valve and to connect in one of its working positions said third control circuit and said second overpressure valve to said return conduit.

7. A control arrangement as defined in claim 3, wherein said third control chamber of said one valve means is controllable by the valve member of said one valve means, and including a fourth control circuit connecting said third control chamber to said consumer chamber of said one valve means.

8. A control arrangement as defined in claim 4, wherein said control space is connected with said first control chamber and wherein the valve member of said one valve means is constructed to establish in its neutral position a connection between said third control chamber and said second control chamber, to block said connection in a first working position and to maintain said connection in a second working position thereof, to separate said circulation chambers from each other in said first working position and to connect said circulation chambers to each other in said neutral and in said second working position.

9. A control arrangement as defined in claim 8, wherein said valve member of said one valve means is constructed to block in its neutral position and in its second working position the second control circuit and to connect in its first working position said second control circuit with said control space of said control valve.

10. A control arrangement as defined in claim 6, wherein said third control circuit is connected to said second control chamber.

11. A control arrangement as defined in claim 6, wherein said valve member of said one valve means has a third working position adjacent the other of its working positions in which the inlet chamber is connected to said consumer chamber, while passage of fluid between said control chambers from said one to said other valve member is blocked.

12. A control arrangement as defined in claim 11, wherein said other working position of said valve member of said one valve means extends over a region between said neutral and the third working position thereof, and wherein said valve member is provided in said region with at least one throttle passage of a cross-section changing uniformly in the longitudinal direction of said valve member.

13. A control arrangement as defined in claim 1, wherein said other valve means includes further a circulation chamber, a return chamber connected to said return conduit and a control chamber between said return chamber and said circulation chamber, and wherein in said neutral position of said valve member of said other valve means, said control chamber is hydraulically blocked while in the working positions of said valve member of said other valve means, said control chamber is connected with said return chamber.

14. A control arrangement as defined in claim 1, and including a one-way valve in said first branch circuit permitting flow of fluid from said supply conduit to said inlet chamber of said one valve means while preventing flow in the reverse direction.

15. A control arrangement as defined in claim 5, and including a one-way valve in said second branch circuit permitting flow of fluid from said supply conduit to said inlet chamber of said other valve means, while preventing flow in the reverse direction, said second control circuit communicating with said second branch circuit downstream of said one-way valve.

16. A control arrangement as defined in claim 1, wherein the open cross-section of said throttle in said neutral circulation circuit is considerably larger than that of said throttle passage in said control valve.

17. A control arrangement as defined in claim 1, wherein the open cross-section of said throttle in said neutral circulation circuit is about ten times larger than that of said throttle passage in said control valve.

18. A control circuit as defined in claim 3, and including a one way valve in said first control circuit between said control valve and said one valve means permitting flow of fluid through said first control circuit to said first control chamber of said one valve means while preventing flow of fluid in the reverse direction.

19. A control arrangement as defined in claim 1, wherein said one valve means receiving a larger amount of pressure fluid from said source is constructed as a single acting valve and said other valve means receiving a smaller amount of pressure fluid from said source is constructed as a double acting valve.

* * * * *